US008819873B2

(12) United States Patent
Embler

(10) Patent No.: US 8,819,873 B2
(45) Date of Patent: Sep. 2, 2014

(54) ERGONOMIC TOILET SEAT POSITIONING DEVICE

(71) Applicant: John William Embler, Oakland Park, FL (US)

(72) Inventor: John William Embler, Oakland Park, FL (US)

( * ) Notice: Subject to any disclaimer, the term of this patent is extended or adjusted under 35 U.S.C. 154(b) by 0 days.

(21) Appl. No.: 13/786,192

(22) Filed: Mar. 5, 2013

(65) Prior Publication Data

US 2013/0263369 A1 Oct. 10, 2013

Related U.S. Application Data

(60) Provisional application No. 61/621,661, filed on Apr. 9, 2012.

(51) Int. Cl.
*A47K 13/10* (2006.01)

(52) U.S. Cl.
CPC ..... *A47K 13/105* (2013.01); *A47K 13/10* (2013.01)
USPC ..... 4/246.3; 4/241; 4/246.1

(58) Field of Classification Search
CPC ..... A47K 13/10; A47K 13/105
USPC ..... 4/241, 246.1, 246.3–246.5
See application file for complete search history.

(56) References Cited

U.S. PATENT DOCUMENTS

| | | | | |
|---|---|---|---|---|
| 933,830 | A | 8/1909 | Davis | |
| 985,535 | A | 2/1911 | Moriarty | |
| 1,063,764 | A | 6/1913 | Anderson | |
| 2,473,082 | A | 2/1945 | Warner | |
| 4,578,830 | A | 4/1986 | Chuang | |
| 4,951,324 | A | 8/1990 | Lirette | |
| 5,461,733 | A | 10/1995 | McKee | |
| 5,940,896 | A | 8/1999 | Berring | |
| 8,087,104 | B2 | 1/2012 | Reynolds | |
| 8,091,155 | B1 | 1/2012 | Sanchez | |
| 8,122,523 | B2 | 2/2012 | Li | |
| 2005/0010998 | A1 | 1/2005 | Mantell | |
| 2007/0079430 | A1 | 4/2007 | Herrera-Gurrola | |
| 2009/0113611 | A1* | 5/2009 | Jarjour et al. | 4/246.3 |
| 2011/0047688 | A1 | 3/2011 | Tong | |
| 2012/0054949 | A1 | 3/2012 | Barcelo | |

* cited by examiner

*Primary Examiner* — Tuan N Nguyen
(74) *Attorney, Agent, or Firm* — Kenneth R. Rice

(57) ABSTRACT

An ergonomic toilet seat raising and lowering device provides a hygienic, effective, and efficient system of lifting and closing a toilet seat with a low susceptibility of being contaminated with urine or fecal matter. The invention includes a lever, a rod and a counterweight positioned away from and behind other components of a common toilet. The invention may be used on toilets and seats with a wide variety of shapes and sizes.

19 Claims, 9 Drawing Sheets

ERGONOMIC TOILET SEAT POSITIONING DEVICE

CROSS-REFERENCE TO RELATED APPLICATION

This application claims priority to U.S. Provisional Patent Application No. 61/621,661, titled "EZupEZdown manual toilet seat lifting and closing device," filed Apr. 9, 2012, the entirety of which is incorporated herein by reference.

FIELD OF THE INVENTION

The present invention relates generally to a seat lifting and closing device, and more particularly relates to a device for lifting and closing a toilet seat.

BACKGROUND OF THE INVENTION

Most restrooms, bathrooms, or other areas designated for users to defecate contain toilets. Modern toilets typically comprise a toilet body, a seat rotatably-hinged and attached to the toilet body, and a flush tank or flush valve. The toilet body includes a bowl, a bowl rim and ledge behind the bowl flush with the top of the rim .Most toilet bodies incorporate two mounting holes located in the ledge for attachment of the seat hinges. The pivot axis of seat hinges is typically parallel with and in close proximity to the transverse centerline of the mounting holes. Flush tank toilets can be one or two piece, with the flush tank integrated into or separate from the toilet body respectively. Toilets can be floor or wall mounted. Typically residential toilets have a closed front seat and a seat lid that can be closed when the toilet is not in use. To minimize contamination and expedite cleaning, public and commercial toilets typically have an open front seat and no seat lid.

Most women urinate and defecate with the toilet seat in the closed position. Men urinating from a standing position may lift the seat to minimize the potential of contaminating the seat with errant urine. In consideration of persons who may subsequently wish to use the toilet with the seat in the closed position, men may lower the seat after urinating. Many women are frequently confronted with toilet seats contaminated with urine or left in the raised position. This situation can result in ongoing intrapersonal strife, particularly in domestic settings. The seat may also be raised or lowered while the toilet is being cleaned.

Many people are reluctant to raise or lower a toilet seat by grasping it with the hands. This can be a very unpleasant and potentially dangerous experience as the toilet seat may be contaminated with urine or feces. Public and commercial toilets are particularly susceptible to this type of contamination. Direct contact with contaminated toilet seats can transmit bacteria, viruses and other pathogens to the user's hands. Even the perception the seat may be contaminated prevents many people from touching it. In addition, many users are physically unable, or find it difficult, to lift a toilet seat, such as small children the disabled, incapacitated and elderly. This concern is especially pertinent in healthcare, educational and retirement facilities.

There have been many devices which attempt to eliminate some of the above described problems. Although there has been a need for such a toilet seat lifting and closing device for many decades, there are none that adequately resolve ergonomic, hygienic, safety and aesthetic requirements while being adaptable to a wide range of existing standard and non-standard toilets and seats.

Industry standards for toilets, incorporating specifications for bowls and hinge mounting holes include those established by the American Society of Mechanical Engineers (ASME) and Canadian Standards Association (CSA) Standards for Ceramic Plumbing Fixtures , Standard ASME A112.19.2-2008/CSA B451-08. Section 4.5.5-Seat-mounting Holes specifies bolt holes be separated by 5.5 inches/140 mm on center, a hole diameter of 0.56 ±0.6 inches/14±1.5 mm, a hole depth of 0.25-0.63 inches/6-16 mm and a space for 1 inch/25 mm washer under the ledge. Section 4.6.6-Rim profiles specifies a bowel rim width of 14.0 inches/356 mm, a length of 16.5 inches/419 mm from the centers of seat mounting holes to the front of the rim for round toilets and a length of 18.5 inches/470 mm from the centers of the seat hinge mounting holes for elongated toilets.

Industry standards for toilet seats include the American National Standards Institute (ANSI) and the International Association of Plumbing and Mechanical Officials (IAPMO) Standards for Plastic Toilet (Water Closet) Seats, Standard IAMPO/ANSI Z124.5-2006. Section 3.2 specifies bolt holes be separated by 5.5 inches/140 mm, a seat width of 14.0 inches/356 mm, a length of 16.25 inches/413 mm from the centers of seat mounting holes to the front of the rim for round toilet seats and a length of 18.25 inches/463.5 mm from the centers of the seat hinge mounting holes for elongated toilet seats.

ASME A112.19.2-2008/CSA B451-08 and IAMPO/ANSI Z124.5-2006 do not specify the transverse width of the ledge at mounting holes, the size and shape of the transition between the toilet bowel rim and the ledge, or clearances between flush tanks, flush valves, or other components located behind the transverse centerline of the mounting holes. Toilet bodies, seats, flush tanks and flush valves conforming to ASME/CSA and IAMPO/ANSI standards have a wide variety shapes, sizes, clearances and obstructions in the areas adjacent to the mounting holes where the seat attaches to the toilet. Toilets and seats not conforming to industry standards may have even greater variations. Many existing designs for toilet seat lifting and closing devices do not accommodate these variations and will not function with a wide variety of both standard and non-standard toilets.

Specifically, U.S. Pat. No. 5,940,896 discloses a sanitary toilet seat apparatus permitting a user to raise and lower a toilet seat without having to touch the toilet seat directly. However, this disclosure disadvantageously incorporates significant portions of the lifting and lowering mechanisms, e.g., primary counterweights and pivot pins as integral components of the toilet seat in close proximity to the pivot axis of the hinges. The apparatus also requires a handle member and secondary counterweight (used for operating the device) to be coupled directly to the toilet seat. This creates a bulky and awkward structure that is not compatible with clearances found on many standard and non-standard toilet bowel, seat and flush tank and flush valve configurations. In addition, many users would find this device to be aesthetically unappealing.

The incorporation of primary counterweights and pivot pins directly into the back of the toilet seat subjects those components to high risk of contamination by feces when the seat is in the closed position, and from errant urine when the seat is in the raised position and major components are fully exposed and forward of the pivot axis of the seat hinges, The greater risk of contamination also increases the clean-up associated therewith, which is particularly counterproductive for those toilets used in the commercial setting. Similar to the primary counterweights and pivot joint, the proximity of the handle member and secondary counterweight to the back of the toilet seat also creates an unhygienic effect because of the potential contamination of fecal and urine fumes, fecal matter and urine splashed from the flushing process, and errant urine that may contact the handle member. Furthermore, the primary counterweights, pivot pins, handle member and secondary counterweight positioned in close proximity to a toilet bowl user, thus causing an obstruction, inconvenience and possible discomfort for the user.

Correspondingly, U.S. Pat. Nos. 8,087,104 , 5,461,733 and 935,535 disclose devices used to raise and lower a toilet seat having a rod attached to a hinge mounted directly to the underside of the toilet seat. These disclosures, however, suffer from similar ergonomic hygienic and aesthetic problems as discussed above. Specifically, most, if not all, of the components of the device are in close proximity to the side of toilet bowl and adjacent to the user, thereby creating an obstruction that is uncomfortable and visually unappealing to many. The proximity to the toilet bowl is unhygienic for the same reasons discussed above. Moreover, it would inapplicable or difficult to use for those users with physical restrictions because the counterweight utilized by this device is only employed for keeping rod upright and inefficiently does not facilitate the user in lifting or raising the toilet. In fact, these devices actually requires a user to exert more force to lift up the toilet seat and/or cover than a typical seat and lid.

Other known toilet seat lifting and lowering devices bear the same drawbacks and deficiencies as the above prior art. Specifically, some devices incorporate the use of a foot operated lever connected to a fulcrum and bracket that allows a user to raise and lower the toilet seat. Pressing on the foot lever with a user's foot raises and lowers lowering the toilet seat. Unfortunately, the foot lever has numerous disadvantages. The floor may be slippery and wet, thereby requiring firm footing near the toilet. Accessing the foot lever may cause slips and falls to a user. Also, a user's clothes may get caught up in the foot lever, creating unbalance and a potential fall by a user. Moreover, those devices also are in an area adjacent to the toilet bowel and susceptible to contamination by fecal matter and urine, and are difficult to maintain and repair. Lastly, many users desire to open or close a toilet seat, but simply forget to. As those foot levers devices are not at eye level and there is no visual cue, many users forget to lift or close a toilet seat. As such, the market is void of a singular device that is available to remedy the above described deficiencies in an effective and efficient manner.

Therefore, a need exists to overcome the problems with the prior art as discussed above.

SUMMARY OF THE INVENTION

The invention provides a toilet seat lifting and closing device and method therefore that overcomes the hereinaforementioned disadvantages of the heretofore-known devices and methods of this general type and that facilitates the lifting and lowering of a toilet seat, while simultaneously reducing the probability of the device being contaminated by fecal matter and urine.

This invention is directed to a novel, non-obstructive, seat raising and lowering assembly that includes essentially a lever, a pivot joint, a rod and a counterweight. The lever, rod, and counterweight extend at a non-obstructive, ergonomic and hygienic distance behind the toilet seat. The lever is coupled to the toilet seat and when desired to be used, the user applies a force on the rod, which transfers to the lever, consequently causing the toilet seat to raise and lower. The lever extends outward from and behind the hinge pivot axis clear to a point clear of any obstructions created by the toilet and seat. The lever's form and dimensions are independent of the size and shape of the toilet seat.

In some embodiments, the assembly may include at least one bracket portion that positions between a rear portion of a toilet bowl and a toilet seat. The at least one bracket portion may engage a sufficient area of the toilet seat so that the toilet seat may be pivotally raised and lowered over a front portion of the toilet bowl.

The rod may be positioned by the rear and side portion of the toilet body or adjacent to the flush tank or flush valve. In some embodiments, at least one hinge assembly may include annular mounts that to the mounting holes on the ledge at the rear of the toilet bowl. The at least one hinge assembly joins the toilet seat to the ledge at the rear of the toilet bowl, serving as a fulcrum, and allowing the toilet seat to pivotally raise and lower above the front portion of the toilet bowl. In this manner, the lever and the bracket portion may utilize each hinge assembly to pivotally rotate along the axis of the rear portion. The lever extends out and away from the ledge at the rear portion of the toilet bowl, terminating at a distal end.

The distal end of the lever may then terminate into the rod. In this manner, the rod may extend along a substantially vertical plane, dependent on the use of counterweight. The counterweight may act as a counterbalance to the weight of the toilet seat as it is being raised and lowered. The combination of the lever and rod may form a junction that may include a pivot joint for allowing rotational movement for the rod. From the junction, the rod may extend upwardly to a handle portion for operating the nonobstructive seat raising and lowering device. The handle portion operates by receiving a downward push, nudge, or tap to pivotally raise the toilet seat. The handle portion may be grasped and lifted upward with sufficient force to pivotally lower the toilet seat.

Although the invention is illustrated and described herein as embodied in a toilet seat lifting and closing device and method therefore, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

Figure 1:
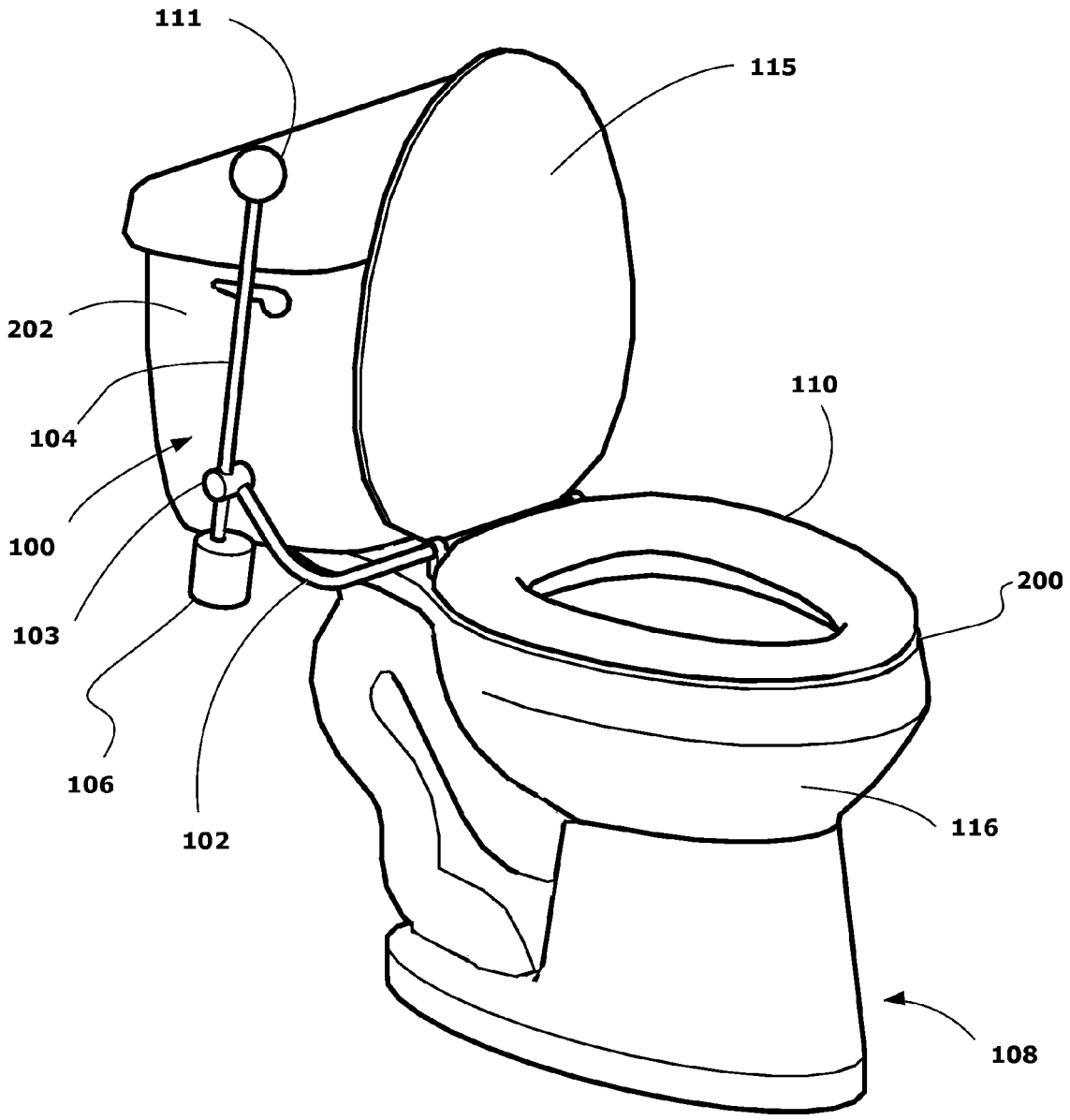
FIG. 1 is a perspective, downward-looking, view of a lifting and lowering toilet seat device coupled to a toilet seat in a closed position, in accordance with the present invention.
Figure 4:
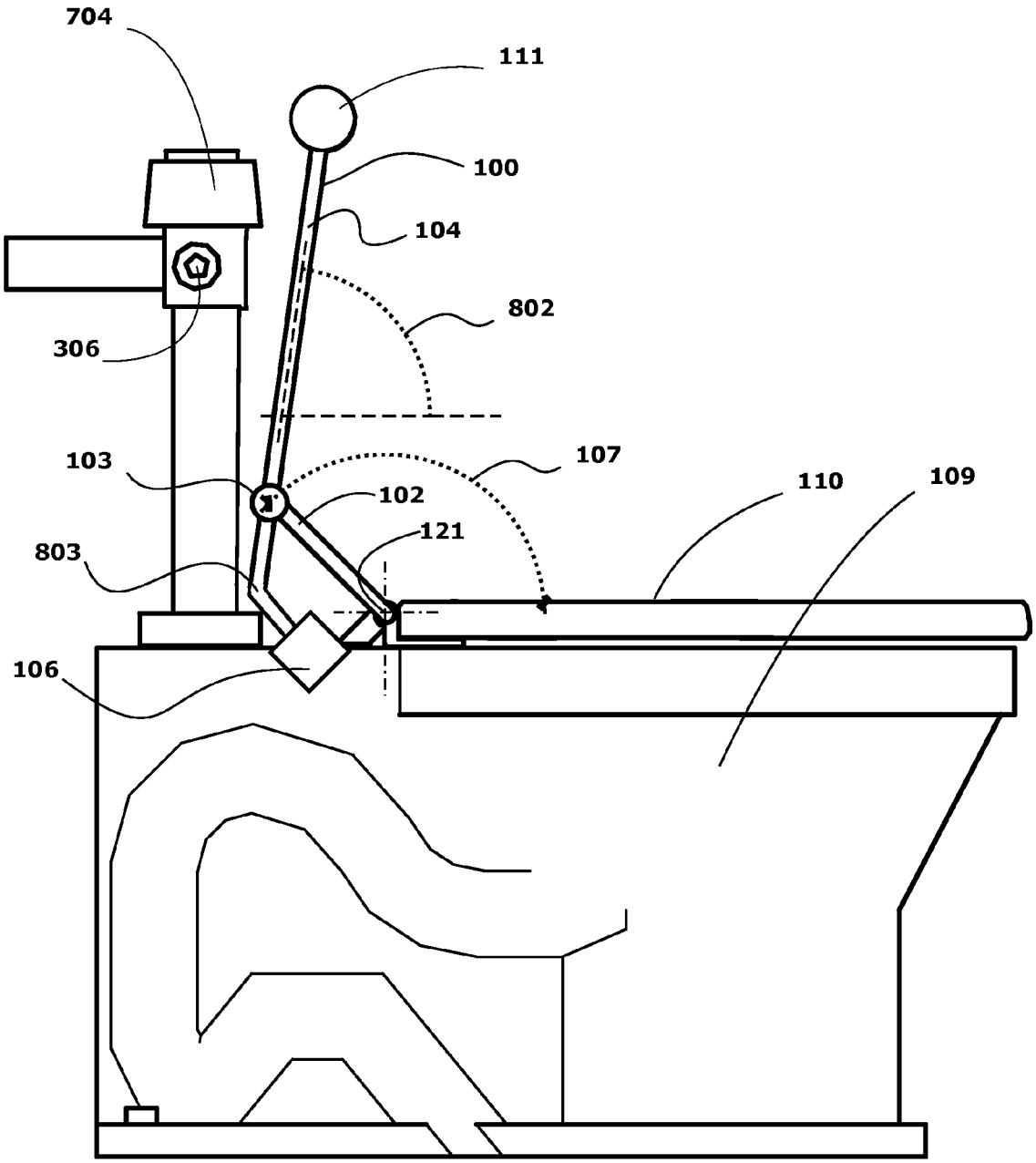
FIG. 4 is an elevational side view of the device of FIG. 1 coupled to the toilet seat in the closed position in accordance with the present invention.
Figure 5:
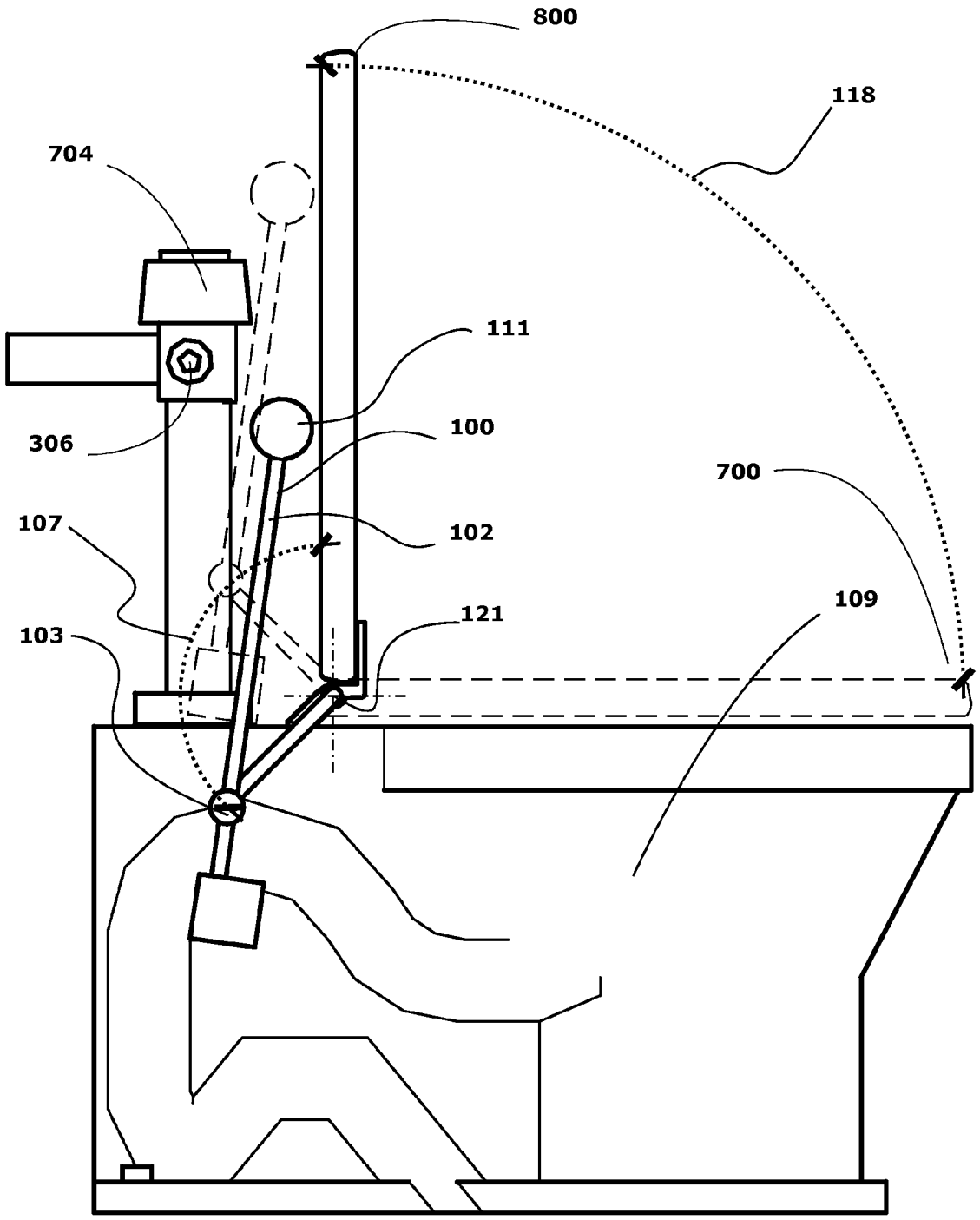
Figure 6:
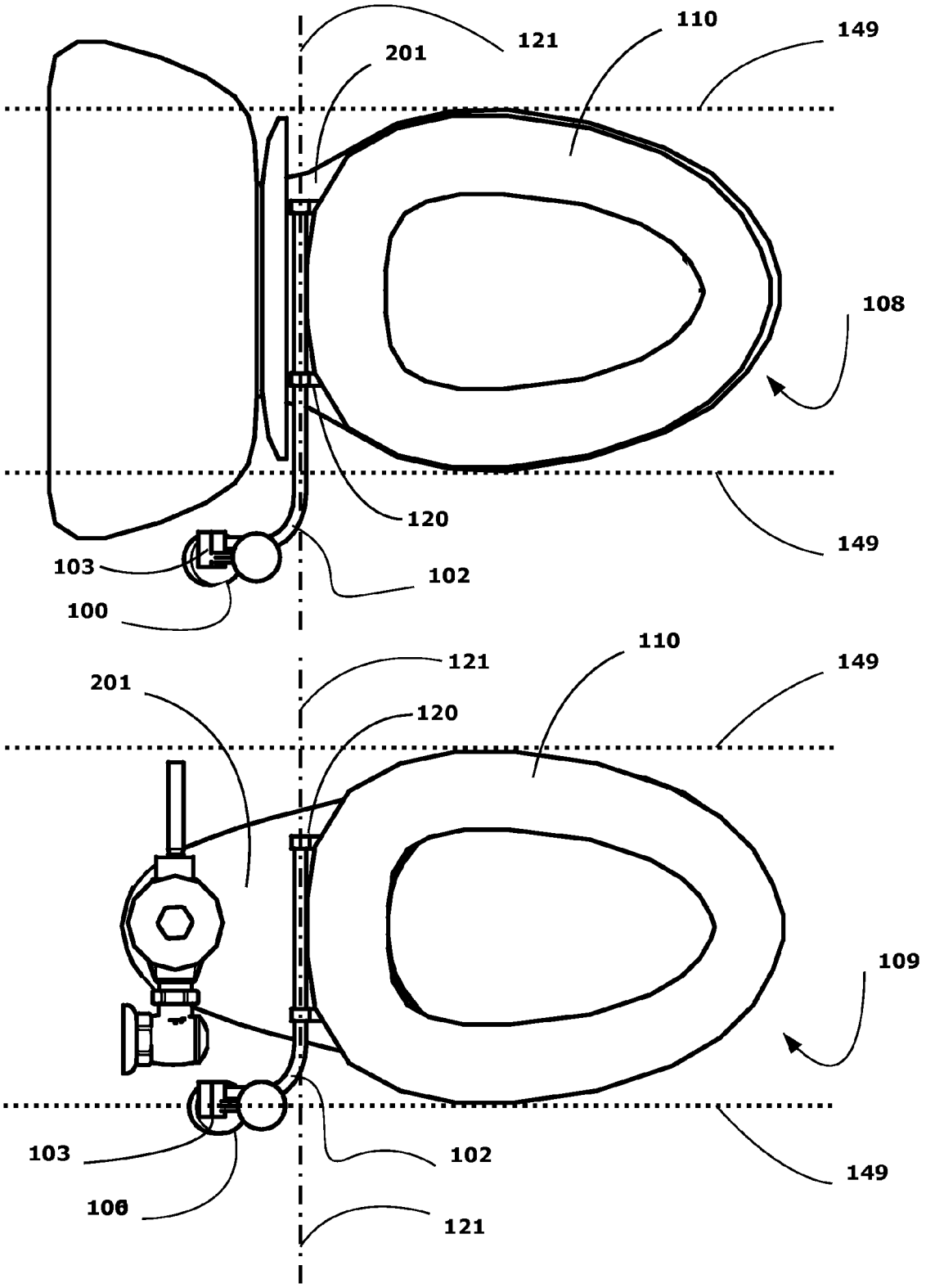
Figure 7:
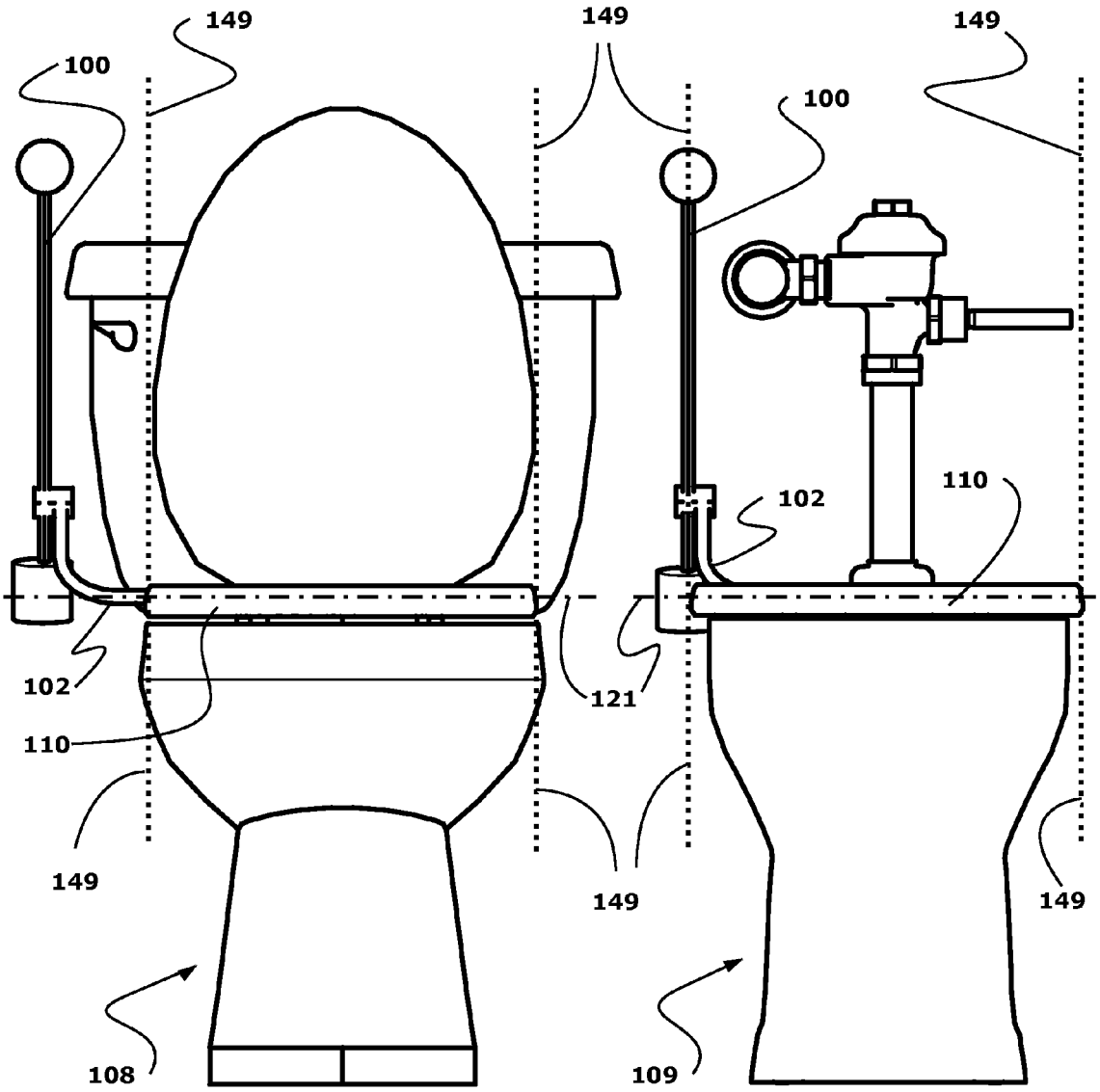
Figure 8:
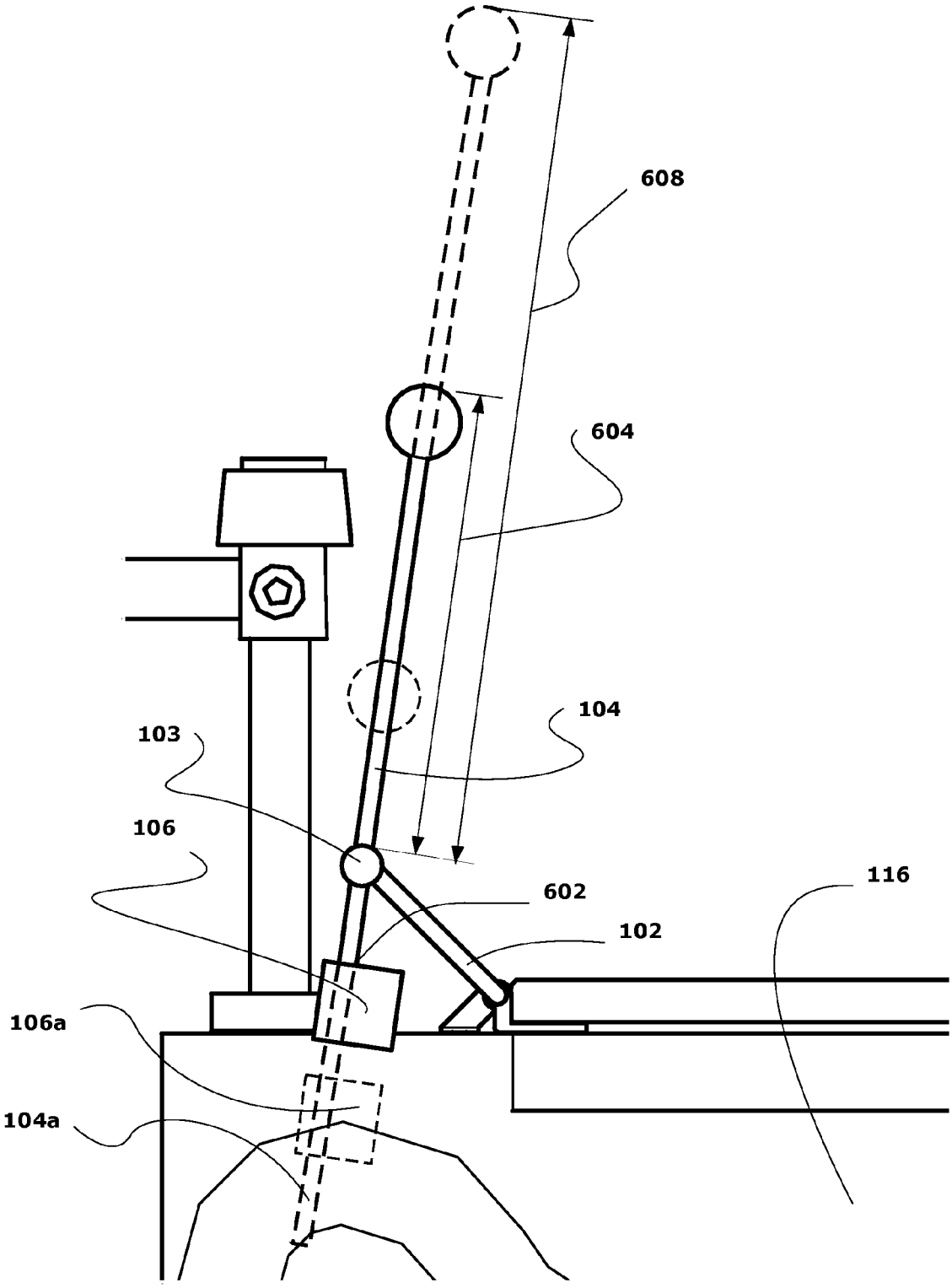
Figure 9:
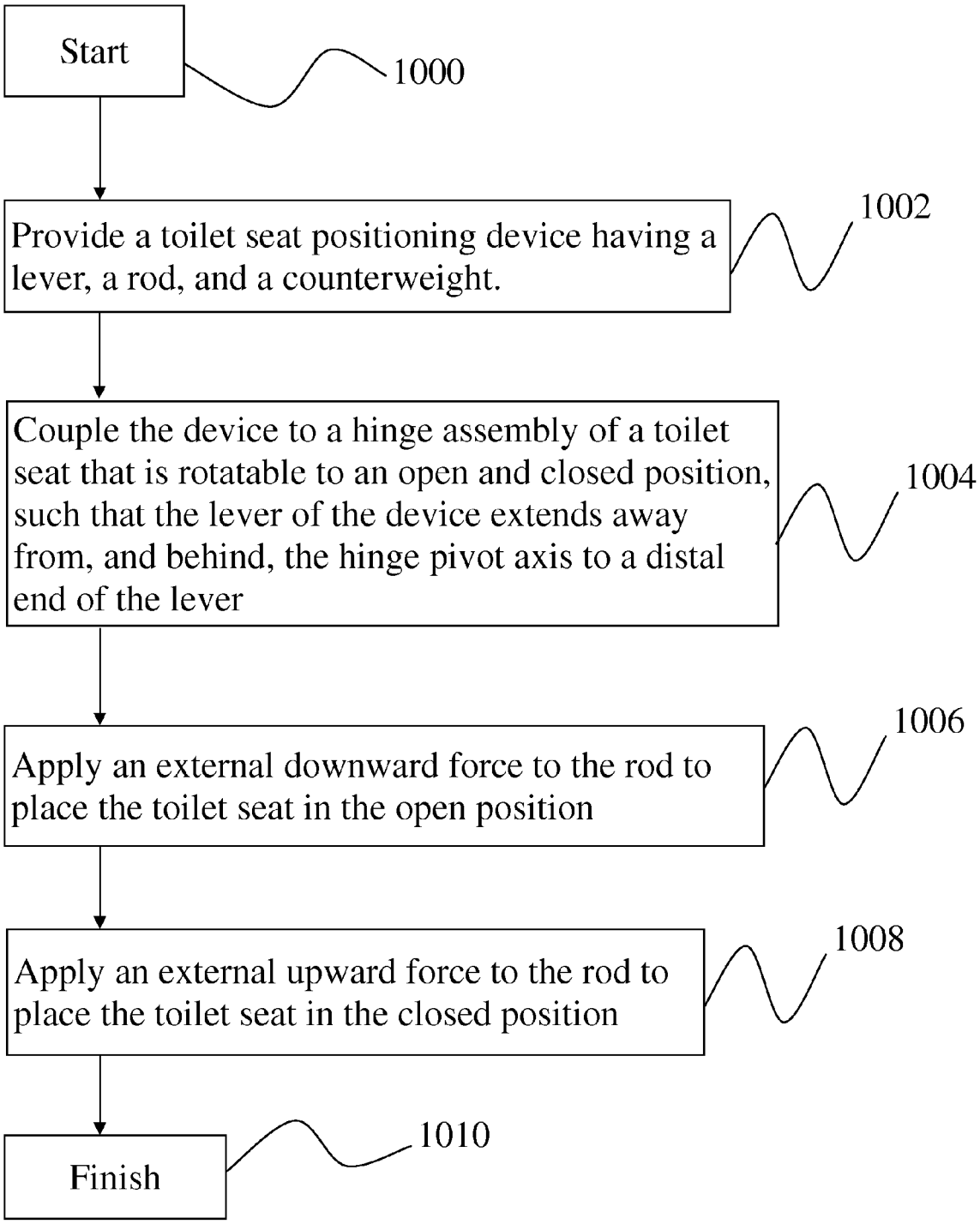

is a top plan view of the device of FIG. 1 with the rod and a substantial portion of the lever located behind the hinge pivot axis of the toilet in accordance with an exemplary embodiment of the present invention;

FIG. 5 is an elevational side view of the device of FIG. 1 coupled to the toilet seat in the open position in accordance with the present invention;

FIG. 6 is a top plan view of a lifting and lowering toilet seat device with the rod and a substantial portion of the lever located extending behind the hinge pivot axis of a flush valve toilet in accordance with an embodiment of the present invention;

FIG. 7 is an elevational front view of the device of FIG. 4 in accordance with an embodiment of the present invention;

FIG. 8 is a fragmentary, elevational side view of the device of FIG. 1 coupled to the toilet seat in the open position in accordance with the present invention;

FIG. 9 is a process flow diagram representing the novel method of lifting and lowering a toilet seat in accordance with the present invention.

DETAILED DESCRIPTION

While the specification concludes with claims defining the features of the invention that are regarded as novel, it is believed that the invention will be better understood from a consideration of the following description in conjunction with the drawing figures, in which like reference numerals are carried forward. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

The present invention provides a novel and efficient device for lifting and closing a toilet seat. It may be ergonomically located away from the user behind the seat hinge which simultaneously reduces the device's exposure to contamination from fecal matter and urine. Embodiments of the invention also provide locations of the device's components that reduce the need of continued maintenance on the device in order to preserve its cleanliness. In addition, embodiments of the invention provide a device having an increased mechanical advantage for a user. The invention may be easily installed on a wide variety of standard and non-standard toilets and seats FIGS. 1-8 show several advantageous features of the present invention. As will be described below, the invention can be provided in several shapes, sizes, combinations of features and components, and varying numbers and functions of the components. A seat positioning device 100 in accordance with the principles of the present invention may provide means for raising and lowering a toilet seat 110, and may include a lever 102, a rod 104 and a counterweight 106. The lever 102 and the rod 104 may be connected by a pivot joint 103. The rod 104 may include a handle 111. The seat positioning device 100 may be incorporated in combination with a flush tank toilet 108. The seat positioning device 100 may also be utilized in combination with a flush valve toilet 109 or other types of toilets or other types of seats. The toilet 108/109 may have a toilet bowl 116 having a bowl rim 200, a rear ledge 201 and mounting hinges 120.

Figure 2:
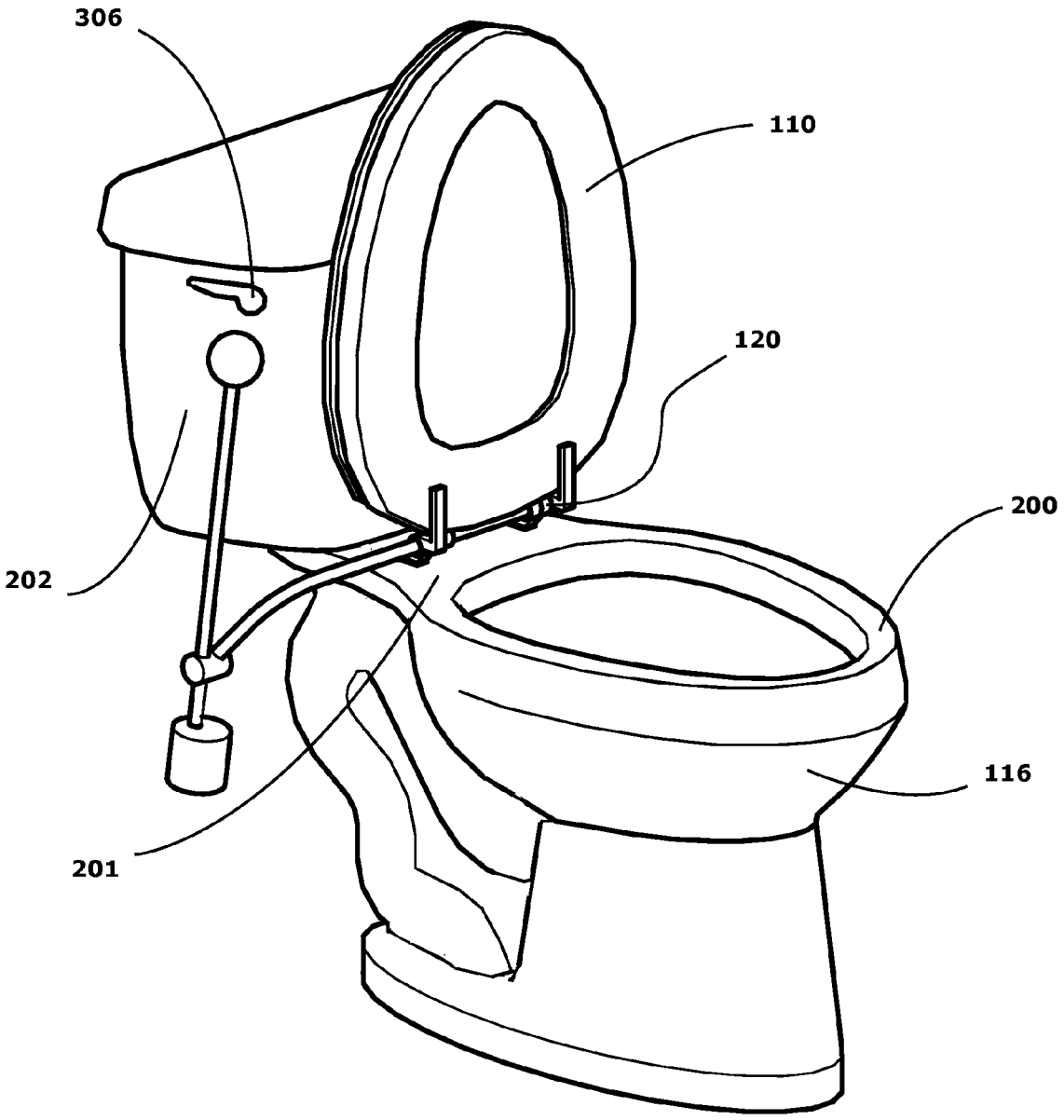
FIG. 2 is a perspective, downward-looking, view of the device of FIG. 1 after placing the toilet seat in an open position, in accordance with the present invention.
Figure 3:
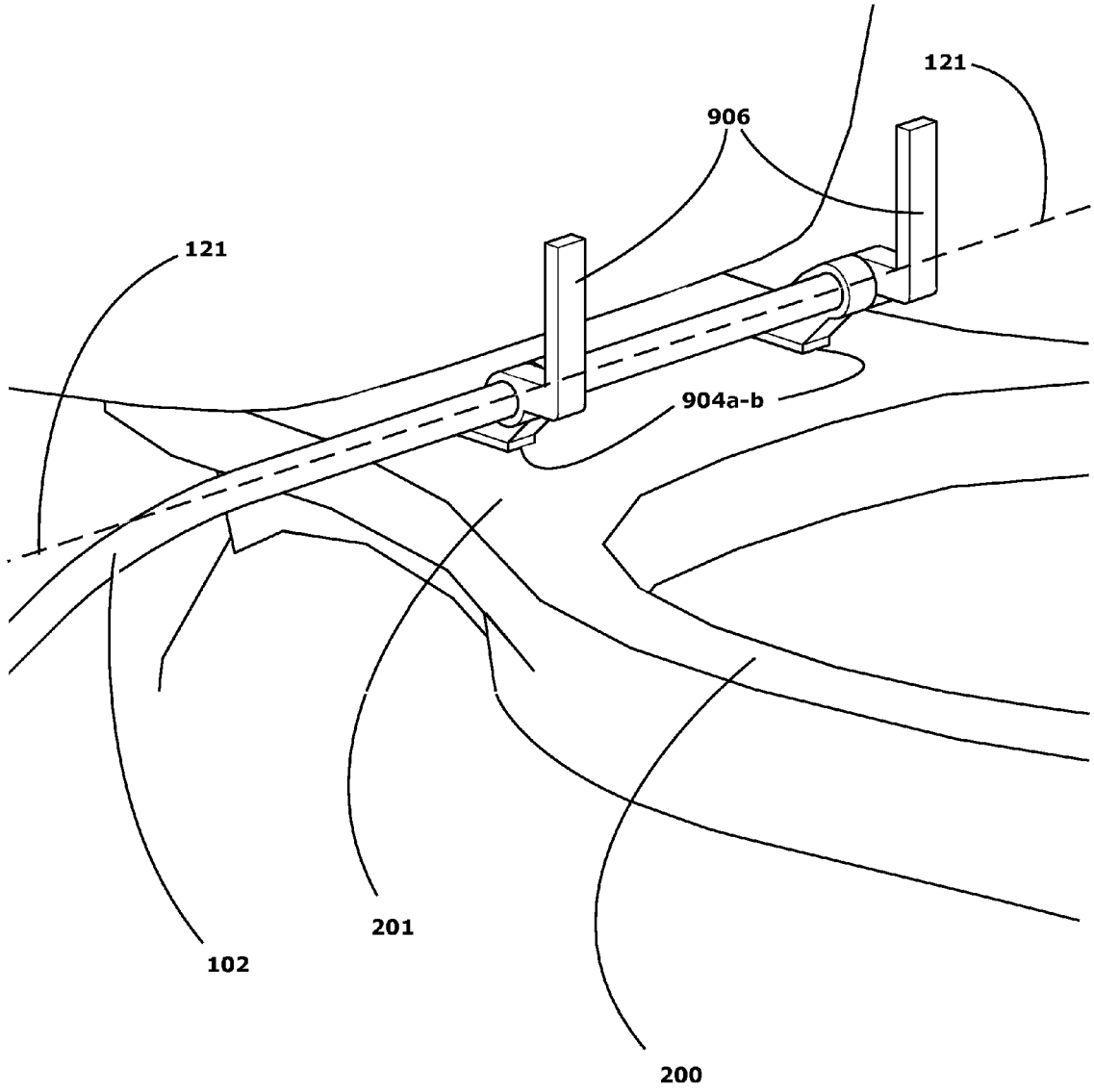
FIG. 3 is a fragmentary, close-up, perspective view of the device of FIG. 1 coupled to a hinge assembly of the toilet with the seat removed in accordance with an embodiment of the present invention.

The toilet seat 110 may be pivotably coupled to the toilet 108/109 by the mounting hinges 120. The mounting hinges 120 may permit the toilet seat 110 to pivot about the hinge axis 121 as shown in FIG. 3 from the closed position of FIG. 1 to the open position of FIG. 2. Although FIGS. 1 and 2 illustrate the seat 110 in one closed and open position, respectively, a seat 110 may have multiple positions, both open and closed, along the toilet seat pivoting path.

The placement of the rod 104 and counterweight 106 behind the hinge axis 121, shown in FIG. 3, may be nonobstructive to the user when in use and may be visually appealing when not in use. For health, personal, and safety reasons, many users desire not to touch the seat 110 in order to raise or lower it. The device 100 may permit a user to circumvent those issues and to conveniently and hygienically raise and lower the toilet seat 110 without direct contact with the seat 110 itself. It is well known that many toilets are subjected to the exposure of fecal matter, and even more specifically, urine generated during the male urination process, in locations other than the toilet bowl cavity. This is especially prevalent in the commercial setting where many users mistakenly urinate outside the toilet bowl cavity, thereby displacing errant urine onto the toilet seat 110 (should it be in the closed position) or the areas in front of and on either side the toilet bowl, and behind the mounting hinges 120.

The lever 102 may extend away from, and behind, the hinge assembly 120 such that it may be a non-obstructive and hygienic distance behind the hinge axis 121 of the mounting hinges. The lever 102 may be pivotably coupled to the hinge assembly 120 and the toilet seat 110, whereby an applied force on the rod 104 may cause the lever 102 rotate the toilet seat 110 into the open and closed positions. FIG. 3 shows the positioning device 100 attached to the toilet 108 without the seat 110 to better show the components of the positioning device 100. One or more bracket 906 are affixed to the lever 102 and rotate about hinge axis 121 when the lever is rotated by downward movement of the lever 104. As the one or more brackets 906 rotate about the hinge axis 121, they lift an attached seat to the raised, open position of FIG. 2. Relatively little force is required to pivot the lever 102 and brackets 906 because the counterweight 106 creates a downward force counteracting the force of gravity acting on the toilet seat. If the seat 110 includes a lid 115 which rotates independently, when the lid 115 is closed the device 100 will rotate both the seat 110 and the lid 115 to the open position. The seat 110 can remain in the open position, or the device 100 can be used to return the seat 110 to the closed position.

The one or more brackets 906 may be affixed, permanently or removably, to a toilet seat by bolts, adhesives, glue screws or other means. The hinge assembly 120 may include a pair of annular mounts 904*a-b* that attach to mounting holes on the rear ledge 201 of the toilet bowl 116, as shown. The lever 102 may then pass through the annular mount 904*a-b*. In some toilet bowl 116 models, it may be necessary to remove the toilet seat 110 and lid to provide the lever 102 access to the mounts 904*a-b*. While the lever 102 may pass from two possible directions of the mounts 904*a-b*, it is necessary for the lever 102 to couple with the hinge assembly 120 in a direction whereby the lever 102 would orient away and behind the hinge pivot axis . A fastener may be utilized to secure the lever 102 in the hinge assembly 120. The lever 102 may then have one or more brackets 906 attached thereto, which are positioned between the upper surface 200 of the toilet bowl 116 and the toilet seat 110. One or more of the brackets 906 may be removable from the lever 102 in order to facilitate coupling the lever 102 to the annular mounts 904*a-b*.

In one embodiment, one of the brackets 906 may have an aperture that permits it to be removed from the end of the lever 102, such that the lever 102 may be slid through the annular mounts 904*a-b*. The bracket 906 may be then be slid back onto the lever 102 and capped, such that it is sandwiched between one of the annular mounts 904*a-b* and the cap. However, any suitable method of coupling the lever 102 to the hinge assembly 120 and the toilet seat 110 may be used. Another such embodiment includes mechanically fastening a plate to the toilet seat 110 and the lever 102 after it is installed onto the mounts 904*a-b*.

When desired to be used, the user may apply an external force to the rod 104 which causes the lever 102 to rotate. Consequently, one or more of the brackets 906 also rotate. The brackets 906 engage with a sufficient area of the toilet seat 110 so that the toilet seat 110 may be pivotally raised and lowered to the open and closed positions, respectively. In some embodiments, the lever 102 may include one or more -brackets 906 that contour and receive one or more portions of the outer perimeter of the toilet seat 110. The one or more brackets 906 may utilize fasteners to attach to the bottom of the toilet seat 110, including, without limitation, screws, adhesives, and magnets. In this manner the pivoting motion of a bracket 906, or other structure, may serve as a lever to lift the toilet seat 110 into an open position. The one or more brackets 906 may be integrated directly into and thus form part of the toilet seat 110.

In some alternative embodiments, the hinge assembly 120 may also include various mechanisms, for example, check, self-sustaining, self-sustaining check, self-raising and adjustable hinges. The present invention may provide the ability to retrofit most styles and designs of toilet such that sections of a check, self-sustaining or adjustable assembly may be removed or exchanged with the present invention. There may be certain instances where the manufacture of a toilet or toilet seat may design the hinge assembly to engage with the present invention. Furthermore, disassembly, and non-use, of certain components of the flush tank toilet 108 or flush valve toilet 109 may be required for assembly of the present invention. Furthermore, the device 100 may either replace a component of the original toilet seat 110, such as a check, self-sustaining or adjustable hinge assembly with a lever 102 and hinge assembly 120 or the device 100 may include its own toilet seat 110, lid, and hinge assembly 120 that attach directly to standard-sized apertures formed on most, if not all, toilets having seats.

FIG. 4 shows a side view of a flush valve toilet 109, toilet seat 110 and positioning device 100 with the seat 110 in the closed or down position. In this embodiment, the pivot joint 103 is located above and behind the hinge axis 121. The lever 102 extends from the hinges 120 backward and behind the seat 110 and upward such that the pivot joint 103, the hinge axis 121 and the seat 110 form an obtuse angle 107. In this embodiment the obtuse angle 107 is approximately 135 degrees, but other obtuse angles may be suitable. When the pivot joint 103 is freely rotatable, the rod generally vertical and perpendicular to the seat 110 due to the force exerted by the counterweight 106 , and as a result would form an obtuse angle with the pivot joint 103 and the hinge axis 121. It may be desirable to provide a pivot joint 103 that creates a bias or includes a stop mechanism that causes the rod 104 to extend at an acute angle relative to horizontal and the seat 110 when closed or down, as shown in FIG. 4. In use, the handle 111 of the rod 104 may be grasped at a variety of angles depending on the ergonomic preferences of an operator. This may allow an operator to exert force upon the handle 111 and rod 104, thereby raising the seat 110, without having to substantially bend over the toilet.

In one embodiment, the counterweight 106 may also function to offset the rod 104 towards the upper portion 200 of the bowl to provide better accessibility for a user. Said another way, one or more portions of the rod 104 may be biased at a non-perpendicular, acute, angle 802 with respect to the upper surface 200 of the toilet bowl 116. The counterweight 106 may also serve an additional purpose of maintaining the longitudinal axis of the rod 104 in a vertical plane when the toilet seat 110 is pivoted between the raised and lowered positions, whereby the handle portion 111 remains accessible. In this manner, the rod 104 extends along a generally vertical, or titled, orientation throughout the translation path of the rod 104 and seat 110.

The rod 104 is shown being substantially straight; however, the top and/or bottom portions of the rod 104 may be curved. The rod 104 may alternatively have an L-shape, be angular or have other geometries. The bottom portion of the rod 104 may include a bend , curve or angle 803 to offset the counterweight 106.

FIG. 5 shows a side view of the flush valve toilet 109, toilet seat 110 and positioning device 100 with the seat in the up or open position. In this example the seat 110 has pivoted about the hinge axis 121 through a translation angle 118 of approximately 90 degrees from a horizontal to a vertical position. The pivot joint 103, hinge axis 121 and seat 110 maintain the obtuse angle regardless of the orientation of the seat 110. However, the rod 104 maintains its substantially vertical position having a bias toward the front of the toilet 108, such that it is no longer approximately perpendicular to or having an acute angle with the toilet seat 110 but now has a negative acute angle relative to the toilet seat 110. Because the rod 104 may be freely rotatable about the pivot joint 103, the extent to which a user standing in front of the toilet 108 must bend over in order to raise the seat is minimized. When the obtuse angle 117 is approximately 180 degrees minus ½ the translation angle 118, the top of the rod 104 and the handle 111 are positioned approximately the same distance behind the front edge of the bowl rim 200 as when the seat 110 was in the lowered position. Thus the he obtuse angle 117 may position the pivot joint 103, rod 104, counterweight 106 and handle 111 at the same ergonomic distance from the front edge of the rim 200 when the seat 110 is in both the raised and lowered positions. For example, a positioning device 100 might be fitted to a seat 110 having a check hinge, a rotation angle of 100 degrees and an obtuse angle of 130 degrees (180 degrees minus ½ the rotation angle).

FIGS. 4 and 5 also illustrate the advantageous placement of the rod 104 and lever 102. In one embodiment, the position of the rod 104 may be substantially behind the hinge axis 121 and may minimize contamination to the rod 104 or portions of the lever 102 not directly coupled to the hinge assembly 120. In other embodiments, the rod 104 may have one or more portions, such as the handle 111, that are behind, or adjacent to, the hinge assembly 120. The rod 104 may be positioned behind the toilet bowl 116 and the user, adjacent to the flushing mechanism 306, which may include the tank 702 or toilet valves 704, or out of the user's immediate vicinity.

The handle portion 111 may be generally an important component of the device to be sanitary, as it comes into the most contact with a user's hand. Many toilet lifting and closing devices place a handle in close proximity to an area of high potential contamination under or adjacent to the toilet bowel and forward of the hinge pivot axis The rod 104 may be positioned adjacent to the toilet in the above described positions and behind the hinge axis 121 and may have a reduced chance of becoming contaminated with errant urine. This placement may also avoid obstructing the user of the toilet 108/109.

FIG. 6 shows top views, and FIG. 7 shows front views of a flush tank toilet 108 and a flush valve toilet 109. FIG. 6 illustrates possible variations in clearances created by the shape of the rear ledge 201 and seat 110 at the hinge rotation axis 121. the lever 102 bends through an arc between the hinges 120 and the pivot joint 103. The lever 102 may alternatively have an L-shape, be angular or have other geometries. To accommodate a wide variety of toilets and seats the location of the pivot joint 103, rod 104, counterweight 106 and handle 306 may be independent of the lateral edge 149 of the toilet seat 110. The lever 102 bends through an arc between the hinges 120 and the pivot joint 103. The lever 102 may alternatively have an L-shape, be angular or have other geometries.

Pivot joint 103 connects the lever 102 and the rod 104 while allowing free rotation about the pivot joint 103. Optionally, the rotation about pivot joint 103 may be limited to less than 360 degrees of free rotation, such for example providing a bias such that it does not rotate backward such that the top of rod 104 and/or the handle 111 is substantially behind the hinge axis 121.

In FIGS. 6 and 7 it may be seen that the pivot joint 103 and rod 104 are located behind the pivot axis 121 independently of the lateral edge 149 of the toilet seat 110. This facilitates free rotation of the rod 104 about the pivot joint 103 in order to improve ergonomic characteristics of the rod, thereby allowing a user to actuate the toilet seat positioning device 100 from in front of the toilet 108/109 with minimized bending over.

The lever 102 and rod 104 may be made with another type of material that does not deform under force exerted by a user. The lever 102 may optionally be substantially slender and form a general L-shape, as shown in FIG. 3. As such, the width of the lever 102 may be noticeably less than the overall length. The shape of the lever 102 may produce a device that reduces the overall area of the device exposed to errant urine. Furthermore, this may reduce the overall weight of the device 100, produce an overall ergonomic and pleasant appearance, and provide a device that may not be bulky or cumbersome. In one embodiment, the lever 102 and rod 104 may be made with a lightweight resilient material such as aluminum, polymers such as PTFE or PVC, or composites or the like. In other embodiments, the lever 102 and rod 104 may be made with another type of material that does not deform under force exerted by a user.

In other embodiments, the lever 102 may bend to form an angle that generally orients the pivot joint 103 such that may be located a position that is substantially adjacent with a flush handle 306 of the toilet 108/109. As the rod 104 may be pivotally coupled to the pivot joint 103 of the lever 102, a majority of the components are located behind the hinge axis 121. Furthermore, the rod 104 may be positioned adjacent to the flushing mechanism 306 of either side of the toilet 108 to provide access for the user. This may reduce the time and cost-intensive maintenance of the device 100 and produce a positioning device 100 that remains in an overall better sanitary condition than other known toilet seat lift and closing devices.

In one embodiment, the flush handle 306 may be the structure or mechanism that activates the influx of water into the bowl, which consequently generates a siphon. This may be the handle attached to the side or front of a tank on the toilet 108, or the handle located on the valve of a flush valve toilet. In other embodiments, the flushing mechanism 306 may be a sensor that activates the flushing mechanism, such as an infrared, movement or sound sensor.

In one alternative embodiment, the lever 102 may be adjusted relative to the lateral side edge 149 of a toilet seat or to alter the obtuse angle 107 formed between the pivot joint 103, the hinge axis 121 and the toilet seat 110 to compensate for differently sized and dimensioned toilet bowls 116 and user features, including, without limitation, a large toilet bowl 116, an awkwardly dimensioned or excessively small bathroom, an obese toilet bowl user, and a handicapped toilet bowl user on a wheel chair. In yet another embodiment, a nonobstructive seat raising and lowering device 100 may be American Disability Act compliant for assisting disabled toilet bowl users with the toilet bowl 116 functions. In one embodiment, the nonobstructive seat positioning device 100 may include an illuminating member for guiding the toilet bowl user in the dark. The device 100 operates by receiving an external downward force, e.g., a downward push, nudge, or tap, to raise the toilet seat 110. The rod 104 may receive an external upward force to lower the toilet seat 110. The rod 104 may terminate into a free end having no attachments, or may terminate into the handle 111. The rod 104 may incorporate other devices including but not limited to cleaning brushes and toilet plungers.

The handle 111 may be ergonomically and decoratively shaped for convenient handling. The ergonomic and decoratively shaped handle 111 may include, without limitation, a spherical knob, a bar with finger imprints, an annular member for facilitated grasping, a figure of an animal, a figure of a plant, and/or a logo or the like. In one alternative embodiment, the handle 111 may include an audio device sensitive to pressure, whereby a blind toilet bowl user would be alerted whether the toilet seat 110 was in a raised position or lowered position.

Referring now to FIG. 8, the rod length 604 (and the distance of the rod 104 from the pivot joint 103, should the rod 104 be biased to a non-perpendicular orientation) may be adjusted by an extending or retracting rod 104 telescoping means. In this manner, the rod 104 may be retracted to remove the rod from the toilet bowl user, such that it will not be possible hindrance. In addition, the rod 104 may be also retracted away from other bathroom fixtures while the toilet 108 is not in use. Moreover, the rod 104 may be extended to a distance 608 that is more accessible to users of various heights or physical capabilities, such as a handicapped user or hospital patient.

The distance 608 between the pivot joint 103 and the handle 111 also may provide a convenient and effective position for the user to open and close the toilet seat 110, regardless of the position of the seat 110. More specifically, the user may not have bend down or crouch to open or lift the toilet seat 110. This may be particularly advantageous for those users with physical restrictions.

It is also safer than those devices located below the toilet bowl 116 (e.g., foot levers) as the user may not have to plant his or her foot on the floor surface or lever, which may be slick because of errant urine or other substances.

The rod 104 may extend downwardly from the pivot joint 103 to terminate into the second end 602. In one embodiment, the second end 602 may terminate at the counterweight 106. In other embodiments, the counterweight **106*a* may be coupled along a portion of the rod 104*a*. The counterweight 106 generally may include a weight that, in combination with any weight produced by the rod 104, lever 102, and handle 111, may be about equal to the toilet seat 110, or any objects attached thereto, in order to facilitate the lifting and lowering of the seat 110. Therefore, the counterweight 106 may produce a moment arm with respect to the fixed point, i.e., the hinge axis 120. When the toilet seat is raised, the x-component of the moment arm generated by the toilet seat 110 may be reduced by some amount, thereby generating a moment about a fixed point that may be lower than the moment produced by the counterweight 106. The closing of the toilet seat 110 may function opposite to the opening of the seat 110. As such, the counterweight 106 may provide balance and also minimize the amount of external force required to be exerted onto the handle 111 for lifting and lowering the toilet seat 110**.

The distance, or x-component, separating the counterweight 106 and the hinge assembly 120 or the actual weight of the counter weight may be varied to adjust the moment required to sufficiently and adequately assist the user in raising and lowering the toilet seat 110. In an additional embodiment, the counterweight 106 may be a weight, or distance away from the hinge assembly 120, sufficient to continually raise the seat 110 in an open position. This may require a user to continually lower the seat 110 should it be desired to be used, preventing unneeded contamination to the seat 110. In an alternative embodiment, a user may also add certain weights to the rod 104 such that the user may selectively choose the desired lifting and/or closing assistance (or lack thereof). In addition to the device 100 providing a greater mechanical advantage than most of those known toilet seat lifting and closing devices, the present invention may incorporate that mechanically advantage with an advantageous position and location of the device's components. Specifically, the position and location may be unobstructive to a toilet user and places the components behind the hinge pivot axis 121 and outside of the potential contamination area for errant urine. In another embodiment, the counterweight 106 may be only used to provide a particular orientation for the rod 104 as it translates through the translation angle 118 and does not facilitate in the seat 100 lifting and lowering process. In another embodiment the length of the rod may be adjusted so the bottom of the rod 104 or counterweight 106 acts as a limiting stop when the seat is in the upright position.

In yet another aspect of the present invention, the non-obstructive seat positioning device 100 comprises of an ergonomic design for convenient accessibility. In this manner, the handle 111 may be accessed while standing and facing the toilet 108/109. In yet another aspect of the present invention, the device 100 is American Disability Act compliant for assisting disabled toilet bowl users with the general toilet 108 functions. Another benefit of the device 100 may be the ability to raise and lower the toilet seat 110 with very little force, due to the counterweight 106 and distance between counterweight 106 and the hinge assembly 120.

With reference to FIG. 9, FIG. 9 represents a process flow chart of a method of lifting and closing a toilet seat. The process starts at step 1000 and then immediately proceeds to step 1002. Step 1002 may include providing the above described novel toilet seat device, which has a lever, a rod, and a counterweight. The next step 1004 may include coupling the lever to the hinge assembly of a toilet with the lever extending away from, and behind, the hinge assembly to a distal end of the lever located behind the seat hinge pivot axis When the device is coupled to the hinge assembly, the rod includes a first end located a distance above an upper surface of a bowl on the toilet. Subsequently following step 1004, the next step 1006 may include applying an external downward force to the rod to place the toilet seat in an open position. The next step 1008 may include applying an external upward force to the rod to place the toilet seat in the closed position. The process may conclude at step 1010.

The invention claimed is:

1. A device for moving the seat of a toilet comprising:
a first hinge bracket fixedly attached to a seat;
a second hinge bracket fixedly attached to a toilet;
a pivot lever fixedly attached to said first hinge bracket;
said pivot lever pivotally attached to said second hinge bracket;
one end of said pivot lever extending to one side of said toilet and towards a rear and a top of said toilet when said seat is in a horizontal orientation;
said one end of said pivot lever terminating in a horizontal pivot joint;
an elongate arm being pivotally attached to said horizontal pivot joint at a point between a first end and a second end of said elongate arm;
a counterweight attached to said first end of said elongate arm such that said counterweight causes said elongate arm to maintain a substantially vertical orientation;
whereby said seat is lifted from said toilet when said elongated arm is pushed in a downward direction.

2. The device as claimed in claim 1 further comprising:
said seat having a horizontal plane;
said end of said pivot lever extending to one side of said toilet and towards the rear and the top of said toilet forms an obtuse angle with said horizontal plane of said seat.

3. The device as claimed in claim 2 further comprising:
said obtuse angle is adjustable.

4. The device as claimed in claim 2 further comprising:
said obtuse angle is substantially 180 degrees minus /1;2 the translation angle of said seat.

5. The device as claimed in claim 1 further comprising:
said pivot lever is substantially straight.

6. The device as claimed in claim 1 further comprising:
said pivot lever is curved.

7. The device as claimed in claim 1 further comprising:
said pivot lever is L-shaped.

8. The device as claimed in claim 1 further comprising:
said elongate arm is adjustable in length.

9. The device as claimed in claim 1 further comprising:
said elongate arm is freely pivotable 360 degrees about said horizontal pivot joint.

10. The device as claimed in claim 1 further comprising:
a handle connected to said second end of said elongate arm.

11. The device as claimed in claim 1 further comprising:
said pivot lever having a pivot axis;
said counterweight is radially adjustable on said elongate arm relative to said pivot axis.

12. The device as claimed in claim 1 further comprising:
said counterweight counterbalances said seat.

13. The device as claimed in claim 1 further comprising:
said counterweight creates a bias of said elongate arm away from said substantially vertical orientation.

14. The device as claimed in claim 1 further comprising:
said counterweight acts as a stop to limit an upright position of said seat.

15. The device as claimed in claim 1 further comprising:
said end of said pivot lever extending to one side of said toilet and towards the rear of said toilet is adjustable in length.

16. The device as claimed in claim 1 further comprising:
said counterweight is adjustable in weight.

17. The device as claimed in claim 1 further comprising:
said counterweight maintains said seat in an open position.

18. The device as claimed in claim 1 further comprising:
a portion of said elongate arm between said horizontal pivot and at least one of said first end and
said second end is curved.

19. The device as claimed in claim 1 further comprising:

a portion of said elongate arm between said horizontal pivot and at least one of said first end and said second end is angled.

* * * * *